US006409321B1

(12) United States Patent
Brugue et al.

(10) Patent No.: US 6,409,321 B1
(45) Date of Patent: Jun. 25, 2002

(54) MODULAR PRINTER/PLOTTER WITH CONTROLLABLE PRINTHEAD/MEDIA SPACING IN THREE DEGREES OF FREEDOM

(75) Inventors: Joaquim Brugue; Manuel Lopez; Jordi Bartolome; John P. Hannaford, all of Barcelona (ES)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/816,995

(22) Filed: Mar. 22, 2001

(51) Int. Cl.[7] ..... B41J 25/304
(52) U.S. Cl. ..... 347/84; 400/52
(58) Field of Search ..... 347/84; 400/55, 400/56, 58, 59, 60, 139, 691, 693

(56) References Cited

U.S. PATENT DOCUMENTS 5,455,607 A * 10/1995 Rhoades et al. ..... 400/59
5,468,076 A * 11/1995 Hirano et al. ..... 400/59
6,234,331 B1 * 5/2001 Brandenberg ..... 211/205

* cited by examiner

*Primary Examiner*—Anh T. N. Vo
(74) *Attorney, Agent, or Firm*—Roth & Goldman

(57) ABSTRACT

A modular printer chassis, particularly for large scale printers, includes a lower media module which provides a rigid platen media support surface connected to an upper scanning carriage support module by a plurality of fasteners which are tightened at the time of assembly to thereafter permanently hold the modules, which are accurately positioned with the aid of a gauge at the time of assembly, in place so that the accurate inkjet printhead to media spacing in the print zone is maintained.

16 Claims, 3 Drawing Sheets

MODULAR PRINTER/PLOTTER WITH CONTROLLABLE PRINTHEAD/MEDIA SPACING IN THREE DEGREES OF FREEDOM

BACKGROUND OF THE INVENTION

The present invention relates to the art of computer driven inkjet printers/plotters, particularly large scale printers having printhead carriage scan widths of about 24 to 60 inches and above although the invention is also applicable to smaller printers as well. Precise spacing between the inkjet orifice plate or plates and the media on which printing is to take place is essential. For this reason, the media is generally supported on a rigid platen below a laterally scanning inkjet printhead or plural inkjet printheads all supported on a common scanning carriage. Those skilled in the art will appreciate that the greater the scan width, the harder it is to maintain precise and substantially constant spacing at all points along the scan width between the inkjet printhead or printheads and the platen supported media on which printing takes place.

It is accordingly the primary objective of the present invention to provide a rigid printer chassis structure which is easily assembled with precise spacing between the inkjet printhead orifices and the media but which also maintains the spacing throughout the design service life of the printer.

SUMMARY OF THE INVENTION

The present invention therefore provides a modular printer chassis comprising: a media module which includes a platen for supporting media on which printing is to take place; a carriage module including structure for supporting a laterally scanning printhead carriage having at least one inkjet printhead thereon in spaced relationship to said platen; and a plurality of fasteners connecting said media module to said carriage module, said fasteners being initially adjustable during connection of said modules to relatively position and thereafter permanently hold said modules in the selected position to accurately support a printhead a selected distance from said platen.

DETAILED DESCRIPTION OF THE PREFERRED EMBODIMENT

Figure 1:
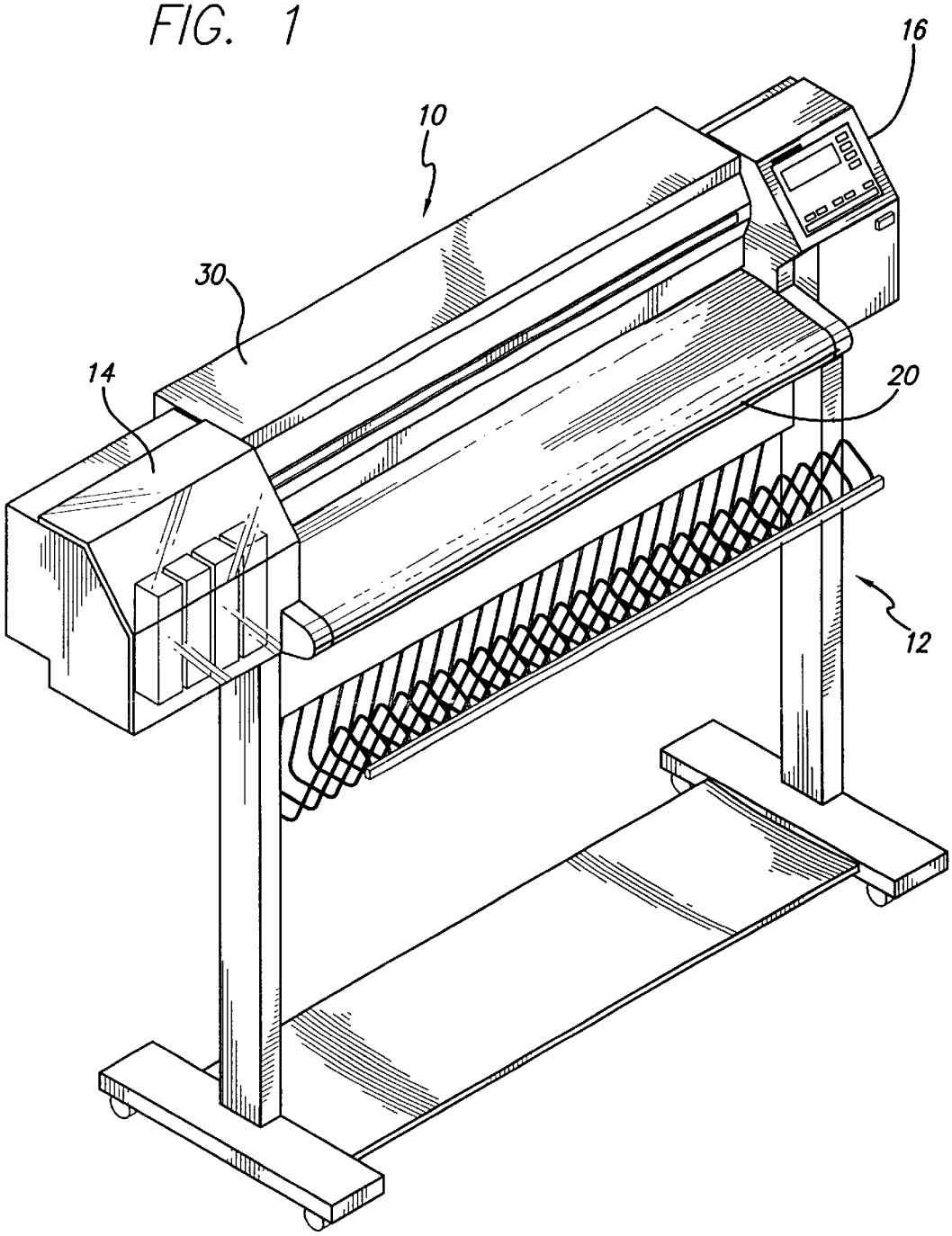
FIG. 1 is an isometric view of a printer in which the invention is used.
Figure 2:
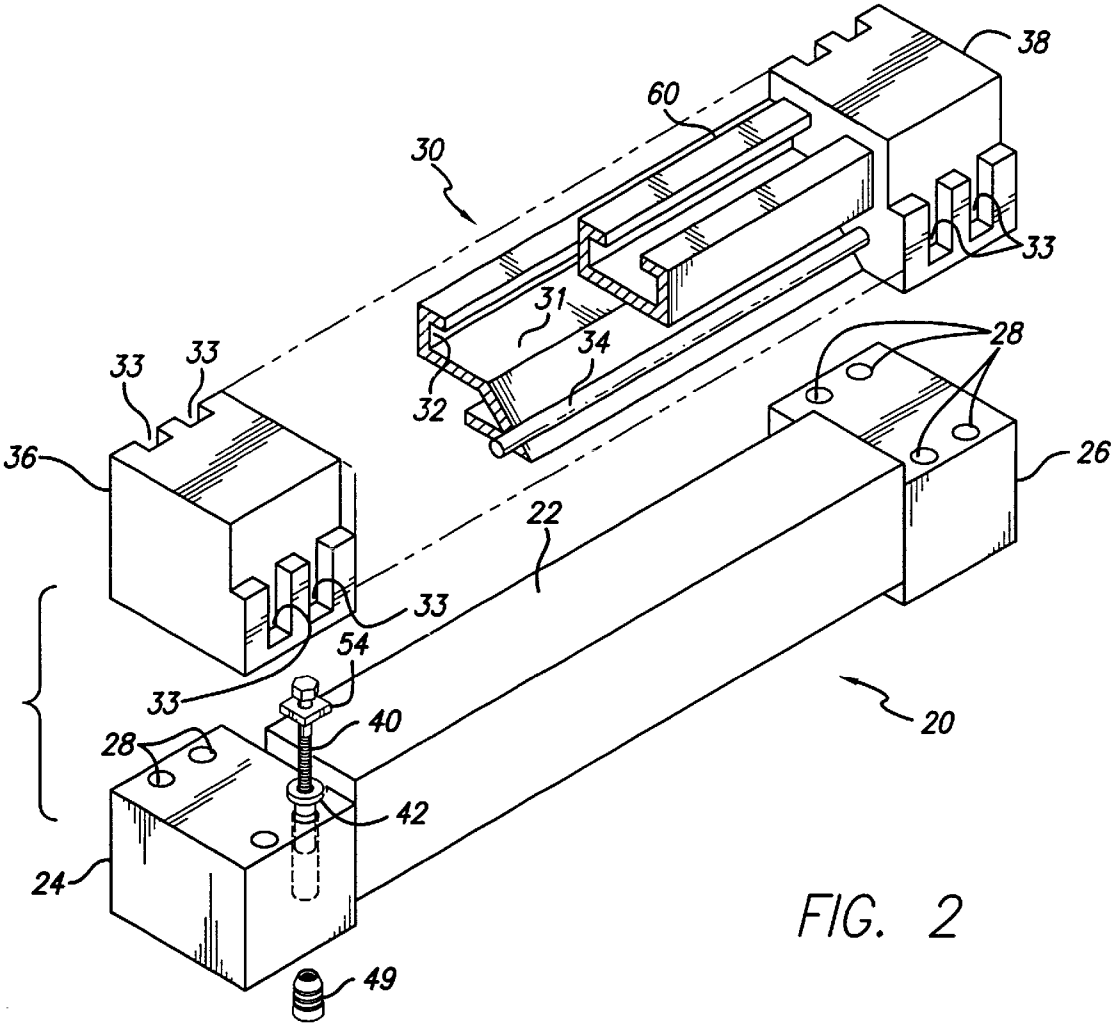
FIG. 2 is a cross-sectional elevation view of one of the eight fastener connections, assembled but not tightened, which permit adjustment with three degrees of freedom of the connection of the carriage module to the media module during assembly.

A typical printer/plotter in which the modular printer chassis structure according to the present invention can be used is shown in FIG. 1 and, pursuant to the invention, includes a lower media module 20 which includes a rigid media support platen 22 and an upper carriage module 30 enclosed in an outer housing 12 which also encloses the scanning printhead carriage and support rods or guides 32, 34, shown schematically in FIG. 2 in which the cover has been removed and shown in phantom for purposes of illustration.

The operative portions of the printer may be supported on a stand 12 and, in the example shown in FIG. 1 further include one or more offboard ink supplies 14 shown at the left side of the media and carriage modules and a printhead service station 16 shown at the right side of the modules. Large scale printers generally use large reservoirs or offboard ink supplies 14 which are connected by flexible ink tubes (not shown) to supply ink to the printhead or printheads mounted on the scanning carriage as is conventional. Smaller size printers such as desktop size printers, in which the modular configuration of the present invention is also applicable, typically use carriage mounted or "onboard" inkjet cartridges which contain a comparatively small supply of ink.

Turning now to FIG. 2 in which the elements of the invention have been shown in schematic block diagram form, it will be seen that the lower or media module 20 includes rigid laterally extending structure usually of sheet metal or extruded aluminum which provides a rigid platen structure 22 to afford a support surface for the media such as paper, transparency, vellum, etc., on which printing takes place. A media drive mechanism to accurately advance the media will also be provided as is conventional. The relatively rigid and expensive platen structure 22 is in turn connected to structural end members 24, 26 by any suitable means. The end members 24, 26 are preferably molded of rigid plastic for cost savings and ease of manufacture. The upper or carriage module 30 includes rigid, preferably steel, laterally extending beam structure 31, broken away for clarity to show its cross-section, which defines an upper carriage guide 32, the beam structure 31 also having a steel carriage support rod 34 affixed thereto. The beam structure 31 including the guide 32 and rod 34 may take any one of various configurations for suitably supporting a scanning inkjet printhead carriage. The carriage module 30 may also include a rigid ink tube guide 60 comprised of a pair of spaced channels suspended above the beam structure 31 if the printer employs offboard ink supplies. One form of ink tube guide suitable for use herein is disclosed in co-pending application Ser. No. 09/240,091 filed Jan. 29, 1999 owned by the assignee of the present invention, the teachings of which are incorporated herein by reference. Both the media module 20 and the carriage module 30 including the beam 31 and attached rod 34 are schematically depicted in boxes for ease of illustration. The ink tube guide 60 is shown partly broken away at its left end for clarity in illustration above the rigid beam structure 31 and support rod 34 however, the channels forming the guide 60 and the relative sizes and positions of the various rigid parts of the carriage module 30 are not critical to nor do they limit the invention.

The carriage module 30 is rigidly affixed to the media module 20 by a plurality of fasteners 40 each comprising a female member 42 received in an aperture 28 of complementary size formed in the end members 24, 26 of the media module and a male member or bolt 50 threadedly connected to the female member 42. The upper ends of each of the fasteners 40 are received in suitably configured seats 33 molded in the end supports 36, 38 of the carriage module 30, the seats 33 each providing engagement surfaces for a purpose to be described. The fasteners 40 define and maintain the spacing between the two modules 20, 30 both in vertical pure translation and tilt (rotation around any horizontal axis).

Figure 3:
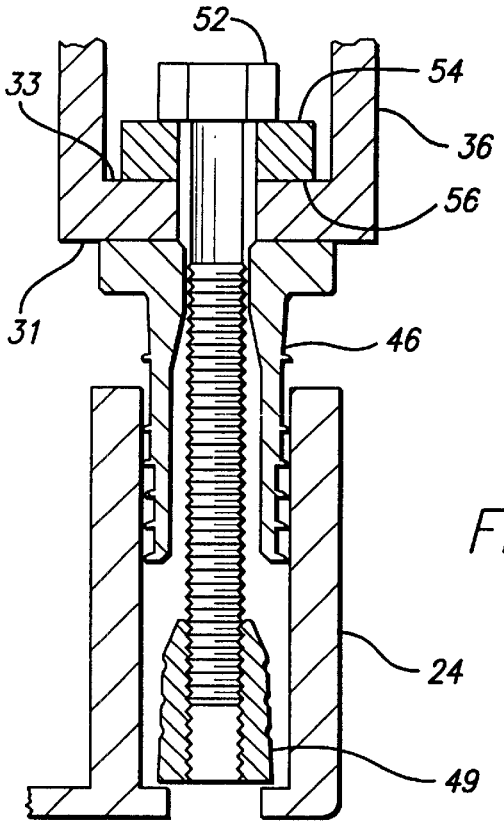
FIG. 3 is a view like FIG. 2 showing the fastener connection tightened in place.
Figure 4:
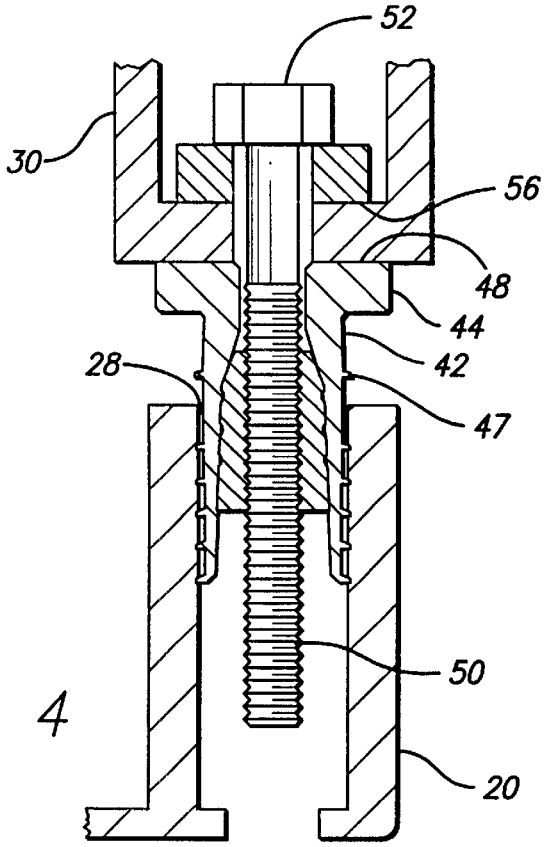
FIG. 4 is a schematic exploded isometric view of assembled modular elements of the printer showing a lower media module and an upper carriage module..

The individual fasteners are shown in FIGS. 3 and 4 to an enlarged scale. The fasteners 40 each include a female member 42 having a head 44 and a depending skirt 46 with a plurality of circumferentially spaced longitudinally extending slots (not shown) which allow the skirt to be radially expanded into firm engagement with the adjacent walls of the apertures 28 in the media module end members 24, 26. The female members 42 are each preferably made of a relatively hard material such as aluminum or steel and are received in the apertures 28 in the relatively soft material of the plastic end members 24, 26 and then held in position therein by expansion of the skirt 46 on each fastener 40 into tight engagement with the walls of the apertures 28.

The bolts 50 each having a head 52 and threaded shank are threadedly engaged with the skirt expanders 49 which, in the presently preferred embodiment shown, comprise separate parts having a tapered generally conical exterior surface slidably engageable with a tapered generally conical interior surface of the skirts 46. Alternatively, the skirt expanders 49 need not be a part separate from the female member 42 but can instead be integrally formed with member 42 as an internally threaded lower end portion of the skirt 46 engageable with the threaded shanks of the bolts 50 as is well known in many different types of radially expandable fasteners which may be used to hold the modules 20, 30 in place.

The heads 52 of the bolts 50 are each configured to be engaged by a complementary shaped tool so that the bolts 50 can be rotated to secure the carriage module 30 in the intended position relative to the media module 20 during assembly at the factory.

The heads 44 of the female fastener members 42 preferably have an essentially flat upper clamping surface 48 and the lower ends of the heads 52 are also preferably flat and preferably receive washers 54 having a generally flat lower clamping surface 56. The clamping 48 and 56 are drawn together during tightening of the female member 42 and bolt 50 and respectively engage the lower and upper sides of the seats 33 in the carriage module.

The modules 20, 30 are relatively positioned by first inserting the female members 42 partly into their respective apertures 28 and using a gauge to then precisely space the carriage module 30 from the media module 20 throughout the entire scanning length of the printhead carriage. The threaded bolts 50 are then inserted through apertures in the seats 33 into the skirt expanders 49 following which the bolts are tightened from the position shown in FIG. 3 to draw the skirt expanders 49 upwardly to radially expand the skirts 46 into tight engagement with the interior walls of the apertures 28 in the media module 20 and simultaneously clamp the oppositely facing engagement surfaces of the seats 33 of the carriage module 30 between the clamping surfaces 48, 56 of the fasteners 40. Preferably, radially extending sharpened teeth or projections 47 are provided on the exterior surface of the fastener skirts 46 so that the projections can be forced into the relatively softer plastic material of the media module 20 to firmly hold the modules 20, 30 in the selected position following which the installation gauge or tools may be removed.

Although the fasteners 40 are shown in FIG. 2 with the female members 42 inserted into apertures 28 in the media module 20, persons skilled in the art will readily appreciate that the female members 42 could instead be received in apertures in the end supports 36, 38 of the carriage module 30 and the bolts 50 could be affixed upwardly through the media module end members 24, 26 instead of as shown in FIG. 2.

The presently preferred arrangement shown in FIG. 2 includes a total of eight fasteners 40 connecting the carriage module 30 to the media module 20. The fasteners are arranged at four corners of the chassis assembly preferably in two planes, one, preferably a vertical plane, containing four fasteners at the front of the printer and the other plane, preferably also a vertical plane, containing four fasteners at the rear of the interconnected modules 20, 30. Although, as shown, the planes in which the groups of fasteners are located are essentially parallel to each other, this too is not considered essential; however, the fasteners 40, if all adjustable in parallel directions, e.g., vertical, can be positioned during assembly to linearly raise or lower the carriage module 30 a precise distance with respect to the media module 20. Slight lateral and slight fore and aft adjustment of the carriage module 30 with respect to the media module 20 is also possible due to the provision of four fasteners 40 at each end by raising or lowering the front fasteners relative to the rear fasteners and/or by raising or lowering the left or right pairs of the fasteners in each end member relative to the other fasteners in each end member whereby adjustability with three degrees of freedom is attained.

Persons skilled in the art will also appreciate that various additional modifications can be made in the preferred embodiment shown and described above and that the scope of protection is limited only by the wording of the claims which follow.

What is claimed is:

1. A modular printer chassis comprising: a media module which includes a platen for supporting media on which printing is to take place; a carriage module including carriage support structure for supporting a laterally scanning printhead carriage having at least one inkjet printhead thereon in spaced relationship to said platen; and a plurality of fasteners connecting said media module to said carriage module, said fasteners being arranged on spaced lines substantially parallel to carriage movement and being initially adjustable during connect of said modules to relatively position and there permanently hold said modules in a selected position to accurately support a printhead a selected distance from said platen.

2. The modular printer chassis of claim 1, wherein said fasteners include a female member having a clamping surface extending a selected distance from one of said modules.

3. The modular printer chassis of claim 2, wherein said female members each include a radially expandable skirt, said skirts of said female members being respectively received in apertures in one of said modules.

4. The modular printer chassis of claim 3, wherein said radially expandable skirts include hard projections on exterior surfaces of said skirts, said projections penetrating into and being engaged with relatively softer adjacent aperture walls of said module to lock said female members in said apertures as said skirts are radially expanded.

5. The modular printer chassis of claim 1, wherein said fasteners are arranged in two spaced laterally extending planes.

6. The modular printer chassis of claim 5, wherein said planes are parallel to each other.

7. The modular printer chassis of claim 6, wherein all of said fasteners extend in parallel directions.

8. A modular printer chassis comprising: a media module which includes a platen for supporting media on which printing is to take place; a carriage module including carriage support structure for supporting a laterally scanning printhead carriage having at least one inkjet printhead thereon in spaced relationship to said platen; and a plurality of fasteners connecting said media module to said carriage module, said fasteners being initially adjustable during connection of said modules to relatively position and thereafter permanently hold said modules in a selected position to accurately support a printhead a selected distance from said platen, said fasteners including a female member having a clamping surface extending a selected distance from said media module, said female members each including a radially expandable skirt, said skirts of said female members being respectively received in apertures in one of said modules, said radially expandable skirts having hard projections on exterior surfaces of said skirts, said projections penetrating into and being engaged with relatively softer adjacent aperture walls of said module to lock said female members in said apertures as said skirts are radially expanded and wherein said fasteners include spaced clamping surfaces respectively engageable with spaced engagement surfaces on said carriage module.

9. The modular printer chassis of claim 8, wherein said fasteners each include mating male and female threaded members, one of said clamping surfaces of each said fastener being on said female member and the other of said clamping surfaces of said fastener being on said male member.

10. The modular printer chassis of claim 9, wherein said female member includes a skirt expander threadedly engaged with said male member.

11. The modular printer chassis of claim 10, wherein said skirt expander is a separate part having a tapered exterior surface slidably engageable with a tapered interior surface of said skirt.

12. A modular printer chassis comprising: a media module which includes a platen for supporting media on which printing is to take place, said platen including a rigid laterally extending structure and end members affixed to said structure; a carriage module including carriage support structure for supporting a laterally scanning printhead carriage having at least one inkjet printhead thereon in spaced relationship to said platen; and a plurality of fasteners connecting said media module to said carriage module, said fasteners being initially adjustable during connection of said modules to relatively position and thereafter permanently hold said modules in a selected position to accurately support a printhead a selected distance from said platen, said fasteners including a female member having a clamping surface extending a selected distance from one of said modules, said female members each including a radially expandable skirt, said skirts of said female members being respectively received in apertures in one of said modules, said carriage module structure includes rigid laterally extending carriage supports and end supports affixed to said carriage supports, said carriage module end supports being affixed to said media module end members.

13. The modular printer chassis of claim 12, wherein said end supports are each connected by sets of said fasteners to said end members such that said carriage module is linearly adjustable during assembly of said modules in a direction toward and away from said media module.

14. The modular printer chassis of claim 13, wherein said rigid laterally extending structured of said media module and said carriage supports are made of metal and said end supports and end members are made of plastic.

15. The modular printer chassis of claim 14, wherein each of said end supports is connected to respective ones of said end members of said media module by at least two laterally spaced ones of said fasteners whereby said carriage module is laterally positionable with respect to said media module during connection of said modules.

16. The modular printer chassis of claim 15, wherein said carriage module further includes an ink supply tube guide connected to said end supports and spaced above said platen.

* * * * *

UNITED STATES PATENT AND TRADEMARK OFFICE

CERTIFICATE OF CORRECTION

PATENT NO. : 6,409,321 B1
DATED : June 25, 2002
INVENTOR(S) : Brugue et al.

It is certified that error appears in the above-identified patent and that said Letters Patent is hereby corrected as shown below:

Column 4,
Line 35, change "connect" to -- connection --;
Line 36, change "there" to -- thereafter --; and Column 6,
Line 23, change "structured" to -- structure --.

Signed and Sealed this

Eleventh Day of February, 2003

JAMES E. ROGAN
*Director of the United States Patent and Trademark Office*